US010249960B2

(12) United States Patent
Thomas et al.

(10) Patent No.: US 10,249,960 B2
(45) Date of Patent: Apr. 2, 2019

(54) DISTRIBUTED ANTENNA SYSTEM AND METHOD OF MANUFACTURING A DISTRIBUTED ANTENNA SYSTEM

(71) Applicant: Alcatel Lucent, Boulogne Billancourt (FR)

(72) Inventors: Alexander Thomas, Hannover (DE); Erhard Mahlandt, Laatzen (DE)

(73) Assignee: Alcatel Lucent, Nozay (FR)

( * ) Notice: Subject to any disclaimer, the term of this patent is extended or adjusted under 35 U.S.C. 154(b) by 66 days.

(21) Appl. No.: 14/354,197

(22) PCT Filed: Oct. 2, 2012

(86) PCT No.: PCT/EP2012/069477
§ 371 (c)(1),
(2) Date: Apr. 25, 2014

(87) PCT Pub. No.: WO2013/060557
PCT Pub. Date: May 2, 2013

(65) Prior Publication Data

US 2014/0292603 A1 Oct. 2, 2014

(30) Foreign Application Priority Data

Oct. 26, 2011 (EP) ..... 11290496

(51) Int. Cl.
*H01Q 21/00* (2006.01)
*H01Q 13/20* (2006.01)
(Continued)

(52) U.S. Cl.
CPC ..... *H01Q 21/0043* (2013.01); *H01Q 1/007* (2013.01); *H01Q 13/12* (2013.01);
(Continued)

(58) Field of Classification Search
CPC .. H01Q 13/22; H01Q 13/0225; H01Q 21/005; H01Q 21/0043; H01Q 21/064
(Continued)

(56) References Cited

U.S. PATENT DOCUMENTS 2,480,181 A 8/1949 Breen et al.
2,635,188 A * 4/1953 Riblet ..... H01Q 21/0062 333/242
(Continued)

FOREIGN PATENT DOCUMENTS

CN 101496225 A 7/2009
DE 886164 B 8/1953
(Continued)

OTHER PUBLICATIONS

The ARRL ANtenna Book, Published by the American Radio Relay League.*
(Continued)

*Primary Examiner* — Hoang V Nguyen
*Assistant Examiner* — Awat M Salih
(74) *Attorney, Agent, or Firm* — Fay Sharpe LLP

(57) ABSTRACT

The present invention relates to a distributed antenna system for transmitting and/or receiving radio frequency, RF, signals, wherein said antenna system comprises at least one elliptical waveguide which comprises a plurality of openings. The present invention further relates to a method of manufacturing a distributed antenna system of the aforementioned type.

20 Claims, 9 Drawing Sheets

(51) Int. Cl.

| | |
|---|---|
| ***H01Q 1/00*** | (2006.01) |
| ***H01Q 13/12*** | (2006.01) |
| *H01P 3/127* | (2006.01) |
| *H01P 3/14* | (2006.01) |

(52) U.S. Cl.
CPC ..... *H01Q 13/20* (2013.01); *H01P 3/127* (2013.01); *H01P 3/14* (2013.01); *Y10T 29/49016* (2015.01)

(58) Field of Classification Search
USPC ..... 343/771, 786; 333/237, 239, 241
See application file for complete search history.

(56) References Cited

U.S. PATENT DOCUMENTS

| | | | | |
|---|---|---|---|---|
| 2,711,440 | A | 6/1955 | Rines | |
| 3,281,591 | A * | 10/1966 | Takeya | B61L 3/225 246/30 |
| 3,648,172 | A | 3/1972 | Nakahara et al. | |
| 3,691,488 | A * | 9/1972 | Holtum, Jr. | H01B 11/1808 29/600 |
| 4,144,510 | A * | 3/1979 | Brown | H01P 11/002 333/241 |
| 4,429,290 | A * | 1/1984 | Devan | H01P 3/14 333/241 |
| 4,590,479 | A * | 5/1986 | Ben-Dov | H01Q 13/12 333/122 |
| 4,613,869 | A * | 9/1986 | Ajioka | H01Q 3/443 342/371 |
| 4,673,905 | A * | 6/1987 | Yamawaki | H01P 3/123 333/239 |
| 4,872,020 | A * | 10/1989 | Ajioka | H01Q 21/0062 343/768 |
| 4,956,620 | A * | 9/1990 | Moeller | H01P 3/123 333/21 R |
| 5,231,411 | A * | 7/1993 | Harrington | H01Q 13/22 343/770 |
| 5,289,200 | A * | 2/1994 | Kelly | H01Q 13/22 343/767 |
| 5,541,612 | A * | 7/1996 | Josefsson | H01Q 25/001 333/237 |
| 5,705,967 | A * | 1/1998 | Pirard | H01Q 13/203 333/237 |
| 7,872,609 | B2 * | 1/2011 | Ou | H01Q 13/0258 343/772 |
| 2003/0038691 | A1 * | 2/2003 | Fiedziuszko | H01P 3/14 333/241 |
| 2007/0063914 | A1 | 3/2007 | Becker | |
| 2010/0066623 | A1 * | 3/2010 | Roemer | H01Q 21/0043 343/771 |
| 2010/0217251 | A1 | 8/2010 | Rossetto et al. | |
| 2010/0321265 | A1 * | 12/2010 | Yamaguchi | H01Q 13/22 343/771 |
| 2011/0234338 | A1 * | 9/2011 | Takahashi | H01Q 13/203 333/237 |

FOREIGN PATENT DOCUMENTS

| | | | |
|---|---|---|---|
| GB | 957702 | A | 5/1964 |
| JP | 43-27062 | Y1 | 11/1943 |
| JP | 43-27062 | Y1 | 11/1968 |
| JP | S-53-87036 | U | 7/1978 |
| JP | 61 154204 | A | 7/1986 |
| JP | 61154204 | * | 12/1986 |
| JP | 4-113708 | A | 4/1992 |
| JP | 7-273511 | A | 10/1995 |
| JP | 9-307346 | A | 11/1997 |
| JP | 2000-286632 | A | 10/2000 |
| JP | 2000-286633 | A | 10/2000 |
| JP | 2002-164734 | A | 6/2002 |
| JP | 2002-335118 | A | 11/2002 |
| JP | 2010-194317 | A | 9/2010 |

OTHER PUBLICATIONS

Waveguide textbook, p. 363. Section 9.1.*
The ARRL Antenna Book, Gerald (Jerry) Hall.*
Waveguide textbook.*
English Bibliography for Japanese Patent Application Publication No. JP 2010194317A, Published Sep. 9, 2010, Printed From Thomson Innovation on May 28, 2015, 4 Pp.
English Bibliography for Japanese Patent Application Publication No. JP 43027062Y1, Published Nov. 9, 2009, Printed From Thomson Innovation on May 28, 2015, 2 Pp.
English Bibliography for Japanese Patent Application Publication No. JP 9307346A, Published Nov. 28, 1997, Printed From Thomson Innovation on May 28, 2015, 3 Pp.
European Pat. App. No. 11290496.6, Extended European Search Report, dated Mar. 12, 2012, 8 pp.
English Bibliography for Chinese Patent Application Publication No. CN101496225A, Published Jul. 29, 2009, Printed From Thomson Innovation on Nov. 13, 2015, 5 Pp.
English Translation on the Fly Result for Japanese Patent Application Publication No. JPS4327062Y1, Published Nov. 9, 1943, (translated on Oct. 16, 2015), 3 Pp.
English Bibliography for Japanese Patent Application Publication No. JP 2000286632A, Published Oct. 13, 2000, Printed From Thomson Innovation on Nov. 13, 2015, 3 Pp.
English Bibliography for Japanese Patent Application Publication No. JP 2000286633A, Published Oct. 13, 2000, Printed From Thomson Innovation on Nov. 13, 2015, 3 Pp.
English Bibliography for Japanese Patent Application Publication No. JP 2002164734A, Published Jun. 7, 2002, Printed From Thomson Innovation on Nov. 13, 2015, 3 Pp.
Koich Mikoshiba et al., "Leaky Waveguide: TEA DEG 01 Circular Waveguide with Periodic Array of Circular Apertures," IEEE Transactions on Microwave Theory and Techniques, vol. MTT-17, No. 1, pp. 15-19, XP001383519, Jan. 1, 1969.
International Search Report for PCT/EP2012/069477 dated Oct. 30, 2012.
European Pat. App. No. 11290496.6, Extended European Search Report, dated Mar. 14, 2012, 8 pp.
PCT Pat. App. No. PCT/EP2012/069477, Written Opinion of the International Searching Authority, dated Oct. 30, 2012, 7 pp.

* cited by examiner

DISTRIBUTED ANTENNA SYSTEM AND METHOD OF MANUFACTURING A DISTRIBUTED ANTENNA SYSTEM

FIELD OF THE INVENTION

The present invention relates to a distributed antenna system for transmitting and/or receiving radio frequency, RF, signals.

The present invention further relates to a method of manufacturing a distributed antenna system of the aforementioned type.

BACKGROUND

It is already known to provide a plurality of discrete antennas such as e.g. dipole antennas in a spatially distributed fashion, e.g. along a tunnel structure or in other buildings to provide suitable radio coverage within the whole structure. Further, it is also known to provide coaxial radiating cables for RF supply within confined spaces, which provide coverage along the cable.

However, deploying a plurality of discrete antennas is very costly due to the requirements of individual mechanical and electrical installation of each discrete antenna and the like, and the coaxial radiating cable has the significant disadvantage of increased attenuation at higher frequencies, e.g. in the GHz range.

Generally, coaxial cable can be operated only up to the so-called cut-off frequency which is a function of the cable diameter. The frequency range supported by this cable is a very important characteristic. The higher the operational frequency is the smaller the coaxial cable has to be. At the same time the attenuation increases with decreasing diameter and increasing frequency. Especially the relatively high attenuation incapacitates coaxial radiating cable to provide RF coverage at frequencies above 4 GHz in long distance systems like tunnels. Repeaters have to be installed in very short distance.

Thus, it is an object of the present invention to provide an improved distributed antenna system and a method of manufacturing such system which avoid the aforementioned disadvantages of the prior art systems.

SUMMARY

According to the present invention, this object is achieved by said antenna system comprising at least one elliptical waveguide having a basically elliptical cross-section, wherein said waveguide comprises a plurality of openings.

According to applicant's analysis, an elliptical waveguide having a basically elliptical cross-section and a plurality of openings may advantageously be employed as a distributed antenna system, because the elliptical waveguide as such is optimally suited for transmitting electromagnetic signals, especially in the RF range, over longer distances since it has a particularly low attenuation even for higher frequencies within said RF range. Thus, no repeaters or the like have to be provided even in large-scale installations with overall waveguide lengths of several hundred meters or more.

By applying the plurality of openings to the elliptical waveguide according to the embodiments, electromagnetic radiation transmitted within the elliptical waveguide in a per se known manner can be evenly distributed to the areas surrounding the elliptical waveguide, since the openings allow electromagnetic waves travelling within the waveguide to leave the waveguide at least to some extent, which inter alia depends on the size and spatial arrangement of the openings. Thus, a radiating elliptical waveguide is obtained according to the embodiments. Consequently, each of the openings according to the embodiments can be considered as a single "antenna" or radiating element, generally speaking. As such, according to a very simple embodiment, the distributed antenna system comprises one single elliptical waveguide which has a plurality of openings, thus forming a very simple configuration of a distributed antenna system.

Apart from the low attenuation for RF signals travelling within the elliptical waveguide, by altering its geometry, the elliptical waveguide may easily be optimised for different frequency ranges. As such, the distributed antenna system according to the embodiments can more easily be scaled to even higher frequencies in the RF range, i.e. to frequencies above 3 GHz, than prior art distributed antenna systems which comprise discrete antenna elements or radiating coaxial cables.

According to an advantageous embodiment, said elliptical waveguide comprises at least one corrugated section which on the one hand increases mechanical flexibility of the waveguide and thus facilitates deployment of the waveguide according to the embodiments in complex scenarios, where e.g. bending of the waveguide is required. Furthermore, the bandwidth of the distributed antenna system according to the embodiments is increased by providing corrugations.

For instance, according to one embodiment, it is also possible to provide a distributed antenna system which comprises first and second sections of elliptical waveguide which are not corrugated and which are connected to each other by a third section of elliptical waveguide which is corrugated and thus offers an increased mechanical flexibility facilitating bending.

According to a further preferred embodiment, the complete elliptical waveguide is of the corrugated type.

According to a further preferred embodiment, the at least one elliptical waveguide is manufactured in one single piece, e.g. as a kind of endless material, which further facilitates installation in the field, because there is no requirement of connecting various smaller waveguide sections by welding or the like in the field.

According to a further embodiment, the openings which enable to radiate electromagnetic waves from the interior of the elliptical waveguide to a surrounding area are comprised within corrugated sections of the waveguide, preferably in radially outer portions of the corrugations. As an alternative, said openings may also be provided in non-corrugated sections of the elliptical waveguide. Combinations of both variants are also possible.

According to a further embodiment, at least one of said openings comprises a substantially elliptical cross-section. Moreover, it is also possible to provide basically elliptical cross-sections with flat edges in the area of the antipodes of the major axis of the elliptical cross-section.

Circular or polygonal cross-sections or other shapes are also possible for implementing the openings within the elliptical waveguide.

According to a further embodiment, different openings, which are provided at different length coordinates of said waveguide, are arranged at different angular positions with respect to a major axis of said elliptical cross-section, which advantageously enables to control a coupling strength for the electromagnetic coupling that characterizes the leakage of RF signals from the interior of the elliptical waveguide to the surrounding area. I.e., the coupling loss decreases when the openings are placed closer to the small axis and increases when the openings are placed closer to the large axis.

According to a particularly preferred embodiment, the angular position increases with a distance from a feeding end of the elliptical waveguide, to which an RF signal transmitter or transceiver may be attached, whereby a longitudinal attenuation for signals travelling within the elliptical waveguide from said feeding end to a second end may be accounted for in that radiating openings which are close to the feeding end are provided such that they enable less coupling between the interior and the surroundings of the elliptical waveguide as compared to further openings which are remote from the feeding end. These further openings may rather be arranged such that they provide an increased electromagnetic coupling between the interior and the outside of the elliptical waveguide to account for the increased longitudinal attenuation the RF signals have suffered prior to arriving at the remote portions of the elliptical waveguide. Thereby, a very homogenous distribution of radiated power from the different openings of the elliptical waveguide along the length coordinate (i.e., parallel to a longitudinal axis) of the elliptical waveguide may be attained.

According to a further embodiment, the cross-section of the waveguide may also comprise a circular shape, e.g. the length of the major axis of the elliptical cross-section is substantially equal to the length of the minor axis of the elliptical cross-section.

Moreover, according to a further embodiment, by providing the various openings at different angular positions with respect to the major axis of the elliptical cross-section, different sections of the elliptical waveguide may be defined which per se comprise a different level of electromagnetic coupling, whereby the RF signal level radiated by the various openings may be controlled independently for the various longitudinal sections of the elliptical waveguide. For instance, a first longitudinal section of the elliptical waveguide may be defined which offers a strong coupling and thus a corresponding RF signal supply outside the radiating elliptical waveguide, whereas a further longitudinal section of the elliptical waveguide may be defined with openings that offer less electromagnetic coupling and thus a correspondingly smaller RF signal supply outside the radiating elliptical waveguide. Anyway, a longitudinal attenuation of the waveguide may advantageously be compensated by choosing an appropriate position of the openings with respect to e.g. the major axis of the elliptical cross-section.

According to a further advantageous embodiment, different ones of said plurality of openings each comprise a different geometry and/or orientation with respect to a surface and/or a longitudinal axis of the waveguide. For instance, a first number of openings of the elliptical waveguide may comprise elliptical or substantially elliptical geometry as already mentioned above, whereas further openings of the elliptical waveguide according to the embodiments comprise a non-elliptical geometry, i.e. a polygonal shape or other geometries.

In analogy to varying an angular position of the openings along the length coordinate of the waveguide, according to a further embodiment it is also possible to vary at least one physical property (size, shape, orientation of a normal vector of the opening's surface) of the openings along the length coordinate of the waveguide. These measures inter alia also enable to compensate a longitudinal attenuation along the length coordinate. For instance, a size of the openings may increase along the length coordinate to compensate for the longitudinal attenuation.

According to preferred embodiment, one or more openings of the elliptical waveguide comprise an orientation with respect to the surface of the elliptical waveguide such that a normal vector of an opening surface of the respective opening is parallel to a normal vector of the respective surface portion of the waveguide the opening is arranged in, i.e. parallel to a radial coordinate of said waveguide.

In the case of a corrugated elliptical waveguide, the openings may either be arranged on the radially outer sections of the waveguide, for example with an orientation such that a surface normal is basically arranged in a radial direction, or on the radially inner sections of the corrugated waveguide. A combination of both variants is also possible for different openings. Orientations of openings such that their surface normal vectors are basically arranged in a partially non-radial (i.e., axial) direction are also possible according to a further embodiment, e.g. on sloped wall portions of the elliptical waveguide defined between radially inner and radially outer sections of corrugations.

According to a further advantageous embodiment, said at least one elliptical waveguide is configured to transmit electromagnetic waves with a frequency of at least 4 GHz.

According to a further advantageous embodiment, said at least one elliptical waveguide comprises a longitudinal attenuation of about 4 dB per 100 meters for electromagnetic waves with a frequency of about 6 GHz.

In contrast, when using prior art distributed antenna systems with radiating coaxial cables, a largest coaxial cable that can be used up to 6 GHz must have an outer conductor diameter of around 19 mm. Using copper conductors and PE foam dielectric, the attenuation of the prior art cable at 6 GHz is approximately 16 dB/100 m. Advantageously, an elliptical waveguide according to the embodiments, for the same frequency band of about 6 GHz, has an attenuation of just 4 dB/100 m. That means the coverage length of a system made with radiating elliptical waveguides according to the embodiments can be approximately 4 times longer compared to a prior art solution with coaxial cable.

According to a further advantageous embodiment, said system comprises at least one transmitter for transmitting RF signals to said at least one elliptical waveguide and/or at least one receiver for receiving RF signals from said at least one elliptical waveguide. The aforementioned devices may e.g. be arranged at a first, i.e. feeding, end of the waveguide and/or at an opposing second end. It is also possible to provide a transceiver which combines transmitting and receiving functionality.

A further solution to the object of the present invention is given by a method of manufacturing a distributed antenna system, wherein an elliptical waveguide is provided (i.e., at least one elliptical waveguide), and wherein a plurality of openings are created within said elliptical waveguide.

According to a preferred embodiment, the openings are created by milling and/or drilling and/or laser cutting respective wall portions of the elliptical waveguide. For example, an elliptical corrugated waveguide of the E60 type manufactured by Radio Frequency Systems could be used as a basis for manufacturing the distributed antenna system according to the embodiments.

Generally, the openings defined in the elliptical waveguide allow electromagnetic waves transmitted by the elliptical waveguide to leave the waveguide to some extent for distribution to free space, which is surrounding the elliptical waveguide. In this way, RF signal supply, i.e. for the purpose of wireless communications can be established in a location which comprises at least one distributed antenna system according to the embodiments.

For instance, a very simple setup for a distributed antenna system according to the embodiments comprises only one single elliptical waveguide comprising a plurality of openings, i.e. the single radiating elliptical waveguide represents the distributed antenna system, according to this very simple embodiment. The plurality of openings represent individual radiating sections ("antennas") providing radio coverage.

Apart from radiating electromagnetic waves in the sense of transmitting, i.e. transmitting signals from the elliptical waveguide via said openings to a space surrounding the elliptical waveguide, a reception of signals is also possible by receiving a portion of electromagnetic signals travelling in an area surrounding the elliptical waveguide by means of said openings and by forwarding said received portions of the electromagnetic field surrounding the elliptical waveguide to one or both ends of the elliptical waveguides, where a receiver device could be arranged in addition to a transmitter device providing the RF signal(s) to be transmitted via the distributed antenna system according to the embodiments.

According to a further embodiment, at least some of said openings are created after a step of installing said waveguide in the field, wherein said step of installing said waveguide in the field preferably comprises bending at least one section of said waveguide. Thus, a very precise creation of radiating sections having said openings is possible, because the position of the openings may be defined depending on the specific mounting condition of the elliptical waveguide in the field, e.g. in a tunnel or the like. In its simplest form, the openings according to this embodiment are made manually by a technician who assesses the mounting condition of the elliptical waveguide in the field and who defines the or further openings in the elliptical waveguide depending thereon, e.g. assisted by measurement and/or simulation equipment for measuring and/or calculating a resulting electromagnetic field distribution with respect to the position of the waveguide and its openings.

BRIEF DESCRIPTION OF THE FIGURES

Further features, aspects and advantages of the present invention are given in the following detailed description with reference to the drawings in which.

DESCRIPTION OF THE EMBODIMENTS

Figure 1:
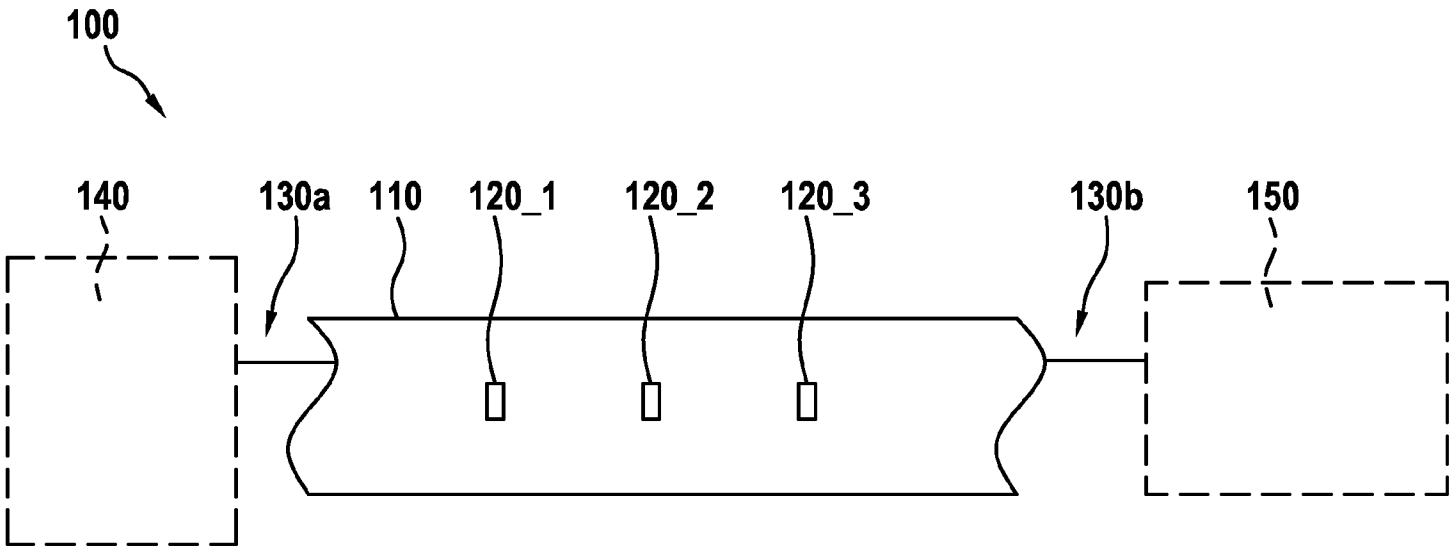
FIG. 1 schematically depicts a top view of a distributed antenna system comprising a single elliptical waveguide according to a first embodiment, FIG. 2 schematically depicts a cross-section of an elliptical waveguide according to an embodiment.

FIG. 1 schematically depicts a top view of a distributed antenna system 100 according to a first embodiment. The distributed antenna system 100 comprises an elliptical waveguide 110 which has a basically elliptical cross-section. The elliptical cross-section of the elliptical waveguide 110 is exemplarily depicted by FIG. 2.

Figure 2:
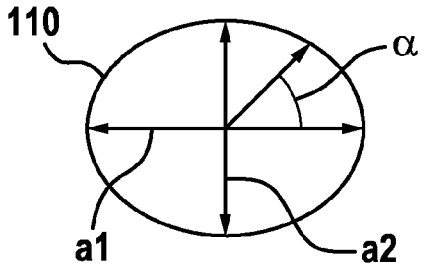

The basically elliptical cross-section as depicted by FIG. 2 may be defined by a major axis a1 and a minor axis a2, which is arranged orthogonal to the major axis a1. An angle $\alpha$ serves to define an angular position of openings comprised within the elliptical waveguide 110 as detailed below.

As can be seen from FIG. 1, the elliptical waveguide 110 has several openings 120_1, 120_2, 120_3 distributed along its longitudinal axis (not shown). The openings 120_1, 120_2, 120_3 advantageously enable electromagnetic waves travelling within the elliptical waveguide 110 to be transmitted from the interior of the elliptical waveguide 110 to a surrounding area outside the elliptical waveguide 110, i.e. to be radiated. As such, each of the openings 120_1, 120_2, 120_3 defines a radiating element or antenna, respectively. On this basis, a minimum configuration according to the embodiments for the distributed antenna system 100 comprises a single elliptical waveguide 110 as depicted by FIG. 1 and a plurality of openings 120_1, 120_2, 120_3 comprised therein.

When connecting the distributed antenna system 100 or the elliptical waveguide 110 thereof to a source of radio frequency signals of suitable frequency, e.g. to the optional RF transmitter 140, said radio frequency signals are transmitted by the per se known mechanism of (hollow) waveguide transmission along the longitudinal axis of the elliptical waveguide 110, i.e. in FIG. 1 from the feeding end 130*a* at the left to the further end 130*b* at the right.

When passing the various openings 120_1, 120_2, 120_3 defined in the wall of the elliptical waveguide 110 according to the embodiments, portions of the RF signal are radiated to the surrounding space thus providing radio coverage for an area surrounding the elliptical waveguide 110.

Reception of RF signals can also be effected, wherein RF signals radiated onto the openings 120_1, 120_2, 120_3 at least partly couple into the elliptical waveguide 110 and are guided to e.g. an optional receiver 150.

Although being arranged at opposing ends 130*a*, 130*b* of the waveguide 110 according to FIG. 1, the devices 140, 150—as well as any other active device used together with the waveguide 110—will preferably be colocated, e.g. at the first end 130*a* of the waveguide 110 or the second end 130*b*—according to a further advantageous embodiment to facilitate service and maintenance tasks. This is possible since RF signals received by the waveguide 110 through its openings 120_1, 120_2, 120_3 are transmitted in both directions (upstream and downstream) of the length coordinate l.

Figure 3A:
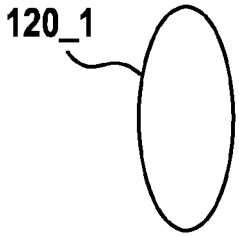
FIGS. 3*a*, 3*b* depict a possible geometry for the radiating openings according to further embodiments, FIG. 4 schematically depicts a partial cross-section of an elliptical waveguide according to an embodiment, FIGS. 5*a*, 5*b* schematically depict further partial cross-sections of elliptical waveguides according to the embodiments.

FIG. 3*a* schematically depicts an opening 120_1 provided within the elliptical waveguide 110 of FIG. 1. As can be seen from FIG. 3*a*, the opening 120_1 comprises a basically elliptical shape, which may be attained by providing an elliptical waveguide that has no openings, and by defining the openings 120_1 therein by means of drilling and/or milling and/or laser cutting.

Figure 3B:
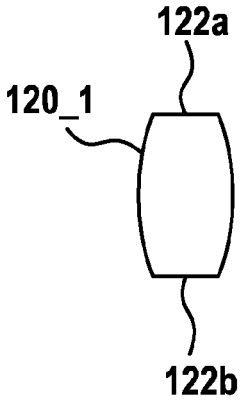

FIG. 3*b* depicts a further geometry for the openings 120_1, 120_2, 120_3 within the elliptical waveguide 110 (FIG. 1), which comprises a basically elliptical shape with two basically flat edge sections 122*a*, 122*b*, which are arranged in antipodal regions of the basically elliptical shape along its major axis.

Further geometries for the openings 120_1, . . . are also possible, e.g. polygonal shapes or circular shapes or the like.

Figure 4:
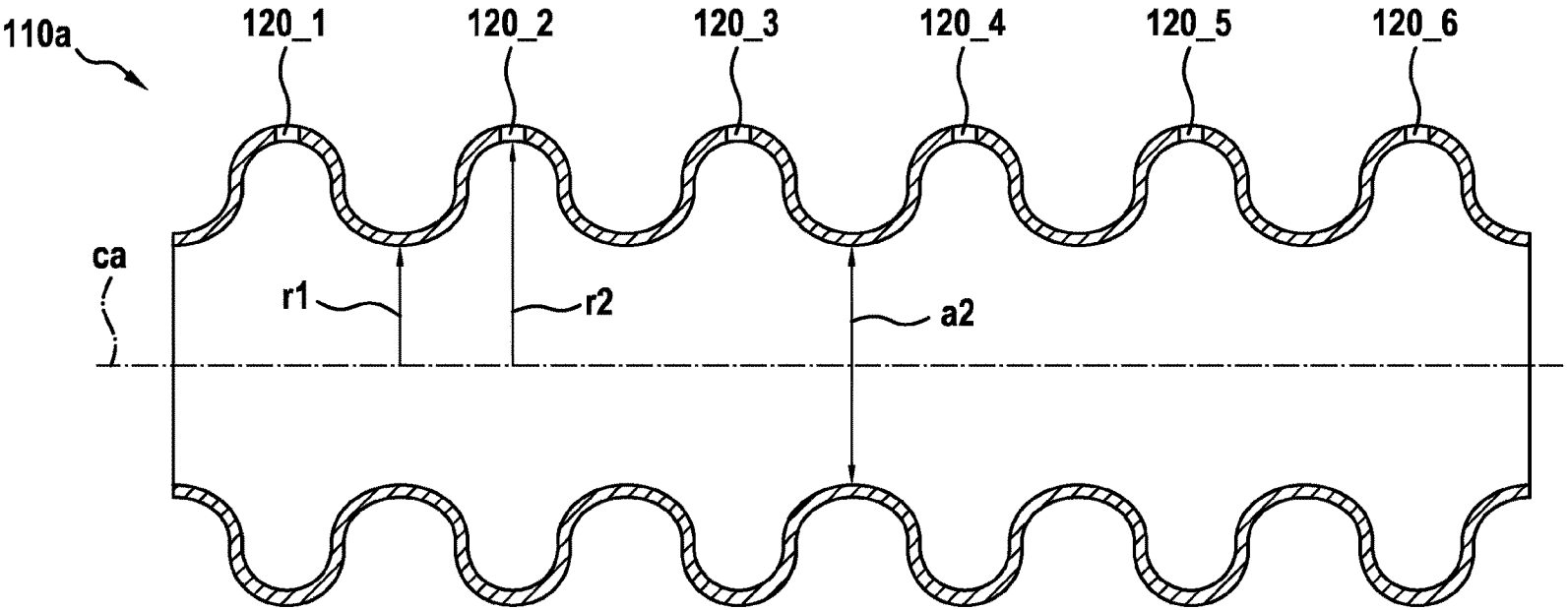

FIG. 4 schematically depicts a partial cross-section of an elliptical waveguide 110*a* according to a further embodiment. The elliptical waveguide 110*a* comprises corrugations, which are defined by alternately providing different radii r1, r2 as seen from a central axis or longitudinal axis ca of the elliptical waveguide 110*a*. As such, the corrugations improve a frequency range for which low attenuation, particularly low longitudinal attenuation, can be attained. Moreover, the corrugated section 110*a* comprises an increased mechanical flexibility and hence advantageously enables to deploy the elliptical waveguide 110*a* in complicated mounting situations which required bending.

As can be seen from FIG. 4, according to the present embodiment, a plurality of openings 120_1, . . . , 120_6 of the elliptical waveguide section 110*a* are provided in the radially outer sections, which comprise a distance r2 from the central axis ca. Moreover, all openings 120_1, . . . , 120_6 comprise basically the same angular position, cf. the angle α as defined above with reference to FIG. 2. For example, the angular position of the openings 120_1, . . . , 120_6 is about α=0°.

However, some or all of the openings 120_1, . . . , 120_6 could alternatively or additionally also be comprised within other sections of the elliptical waveguide 110*a*, for example in the radially inner sections at a distance r1 as seen from the central axis ca or at the sloped connecting sections between the radially inner sections at radius r1 and the radially outer sections at radius r2.

Likewise, some or all of the openings 120_1, . . . , 120_6 could alternatively or additionally also be arranged at different angular positions, i.e. α<>0°.

The inner diameter a2 (minor axis) together with the major axis a1 inter alia define the operational frequency range of RF signals which can be transmitted by the waveguide 110*a*.

Figure 5A:
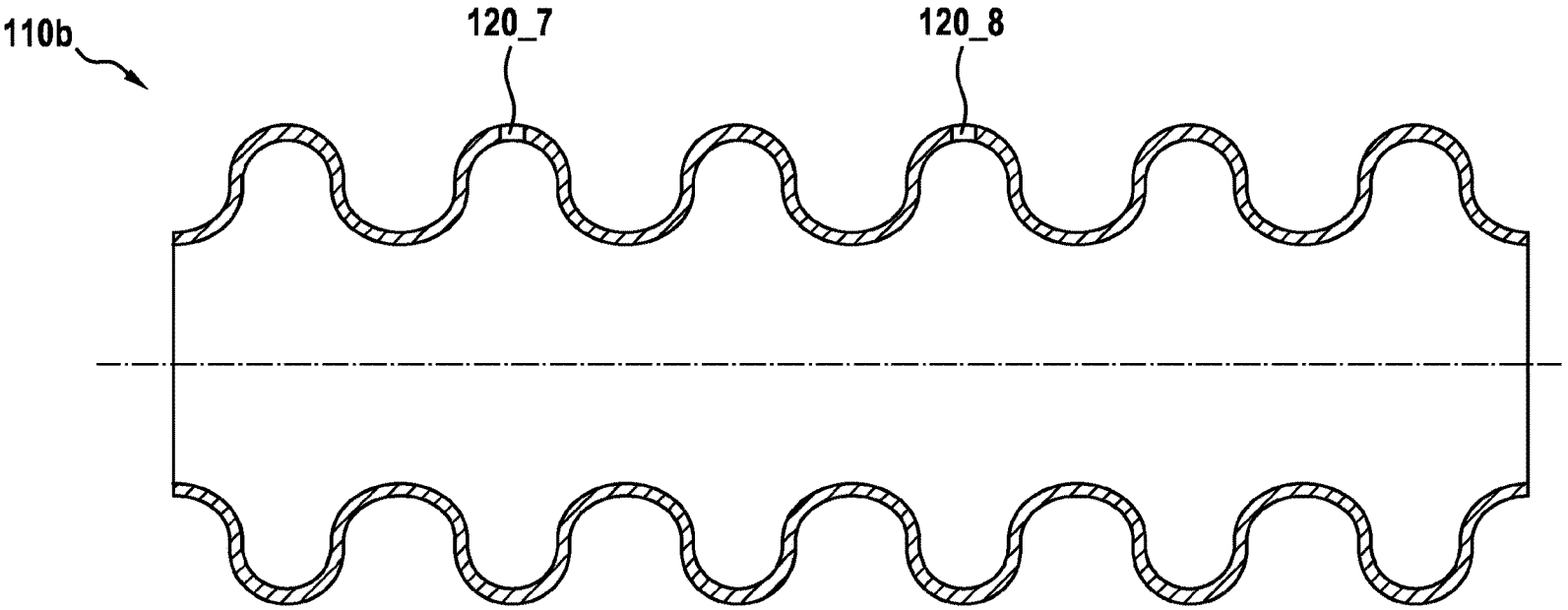

FIG. 5*a* depicts a further embodiment of an elliptical waveguide 110*b* that may be used for the distributed antenna system 100. According to the present embodiment, only every second radially outer section of the corrugated surface of the elliptical waveguide 110*b*, as seen along the central axis ca, cf. FIG. 4, comprises a respective opening 120_7, 120_8 for radiation of electromagnetic waves from the interior of the elliptical waveguide 110*b* to a surrounding space.

Figure 5B:
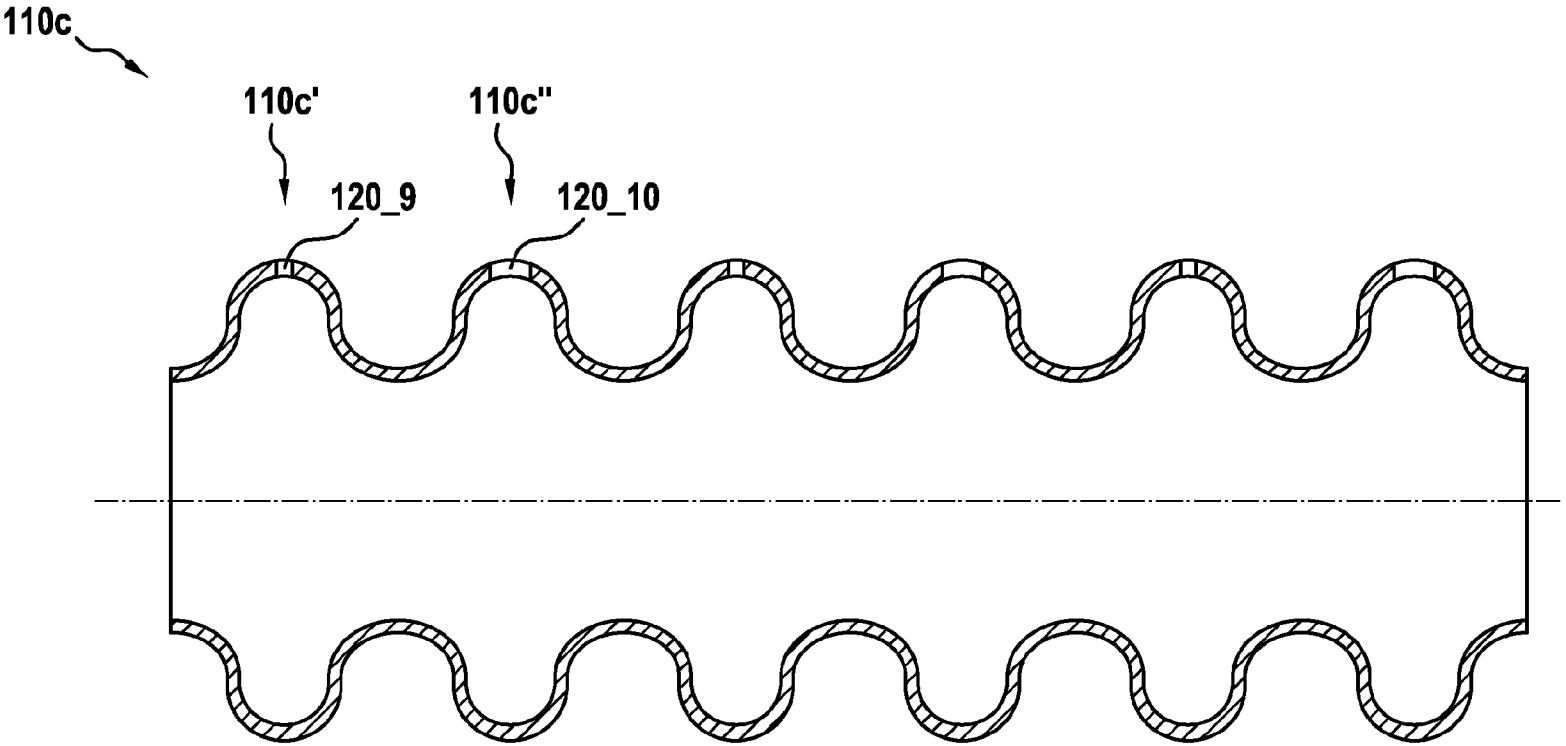

FIG. 5*b* depicts a further embodiment of the invention, wherein different sections of the elliptical waveguide 110*c* comprise openings of different geometry. For instance, a first portion 110*c*' of the elliptical waveguide 110*c* comprises an opening 120_9 comprising a first, comparatively small, geometry, whereas a second section 110*c*" of the elliptical waveguide 110*c* comprises an opening 120_10 comprising a comparatively large geometry, and so on.

Figure 6:
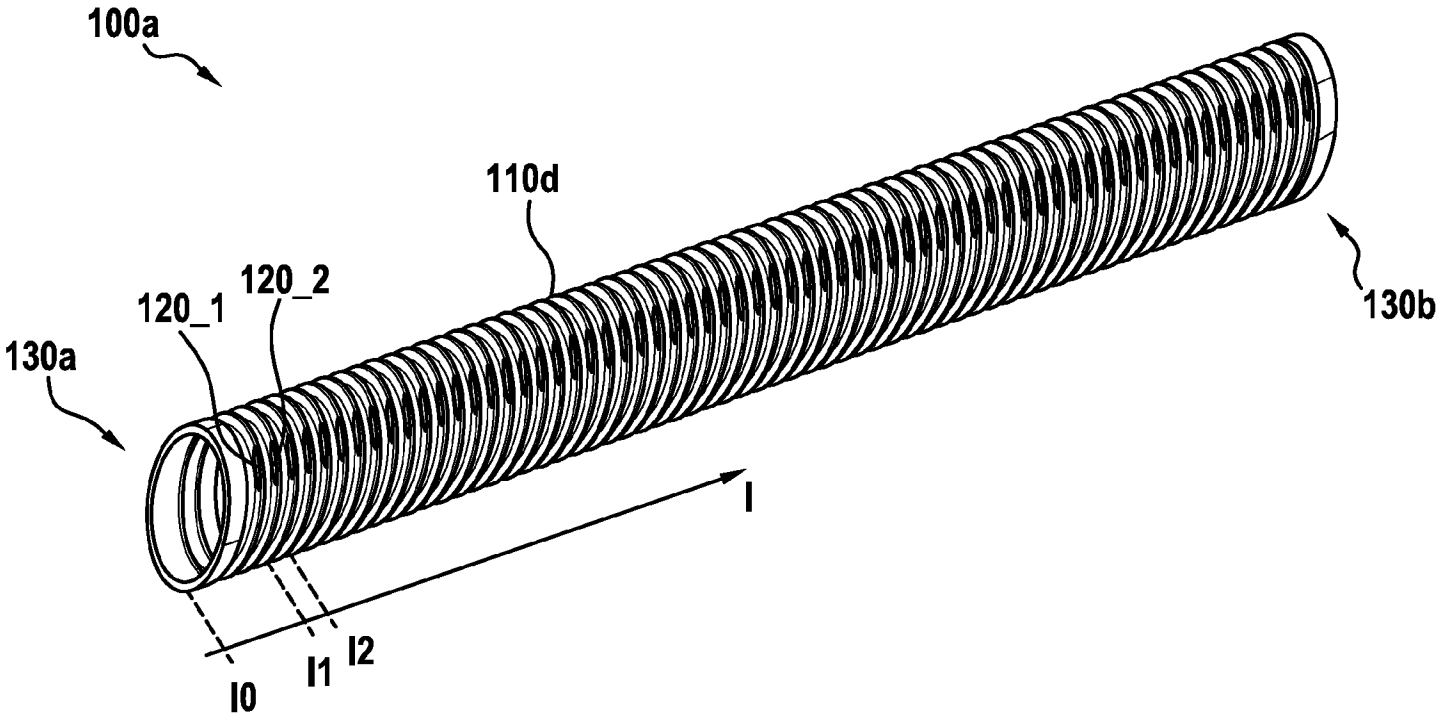
FIG. 6 depicts a perspective view of an elliptical waveguide according to an embodiment.

FIG. 6 depicts a perspective view of a distributed antenna system 100*a* according to a further embodiment. A length coordinate l extends along the central axis ca (FIG. 4) of the waveguide 110*d*, and a feeding end 130*a* is arranged at the length coordinate l=l0 of the elliptical waveguide 110*d* of the distributed antenna system 100*a*. I.e., a radio frequency signal source (not depicted) could be connected to the elliptical waveguide 110*d* at said feeding end 130*a* to couple RF signals to be transmitted via said elliptical waveguide 110*d* into said waveguide 110*d*. Alternatively or in addition, receiving means (not shown) could also be arranged at the feeding end 130*a* or at the other end 130*b* of the elliptical waveguide 110*d* as depicted by FIG. 6.

As can be seen from FIG. 6, the elliptical waveguide 10*d* comprises a plurality of openings 120_1, 120_2, . . . each of which is arranged at about the same angular position with respect to the major axis a1 (FIG. 2) of the elliptical cross-section, i.e. presently at about α=−30°. Furthermore, a longitudinal distance l2-l1 between neighbouring openings 120_1, 120_2 is basically constant over the whole length of the elliptical waveguide 110*d*.

The first opening 120_1 as seen from the feeding end 130*a* of the elliptical waveguide 110*d* is presently located at a position l=l1, whereas a second opening 120_2 as seen from the feeding end 130*a* of the elliptical waveguide 110*d* is arranged at a second longitudinal position l=l2.

The distributed antenna system 100*a* as depicted by FIG. 6 provides a comparatively homogenous RF signal supply over its whole length, i.e. up to the second end 130*b*.

Advantageously, a longitudinal attenuation is comparatively low as compared to radiating coaxial cables or the like. Moreover, the operating frequency range of the elliptical waveguide 110*d* is easily scalable by altering the geometry of the waveguide.

According to a further embodiment (not shown), different openings 120_1, 120_2, . . . of the elliptical waveguide 110*d* (FIG. 6), which are provided at different length coordinates l1, l2 of said waveguide 110*d*, are arranged at different angular positions with respect to the major axis a1 (FIG. 2) of the elliptical cross-section of the waveguide. This advantageously enables to control a coupling strength between the interior of the elliptical waveguide 110*d* and the exterior which enables to compensate a longitudinal attenuation of RF signals travelling within the elliptical waveguide 110*d*.

For instance, according to a particularly preferred embodiment, the angular position α as defined by FIG. 2 increases with a distance 1 from the feeding end 130*a* (FIG. 6) of the elliptical waveguide 110*d*. For a first angular position α=0, i.e. an opening being arranged at an antipodal point of the major axis a1 of the elliptical cross-section, a comparatively high coupling attenuation is attained for electromagnetic radiation passing said opening. This is particularly suitable for such openings 120_1, 120_2 (FIG. 6), which are comparatively close to the feeding end 130*a* of the elliptical waveguide 110*d*, because an RF signal travelling within the elliptical waveguide 110*d* has only suffered comparatively small longitudinal attenuation when reaching the openings 120_1, 120_2 due to their proximity to the feeding end 130*a*, and thus only few RF energy is to be radiated for attaining a required electromagnetic field strength outside these openings.

However, to account for an increased longitudinal attenuation of said RF signal when reaching further, remote openings, which may e.g. be arranged close to the second end 130*b* of the elliptical waveguide 110*d*, the angular position α (FIG. 2) may by varied, for example up to α=90°, so as to attain a decreased coupling loss (minimum coupling loss for α=90°) for the coupling mechanism that affects radiation of electromagnetic waves from the interior of the elliptical waveguide 110*d* to its exterior. Thus, by placing the various openings of the elliptical waveguide 110*d* at different angular positions α (FIG. 2) along the longitudinal axis l (FIG. 6), a particularly homogenous supply of the exterior of the elliptical waveguide 100*d* along its longitudinal axis l may be attained in spite of a longitudinal attenuation. Thus, even large installations with waveguide lengths of several hundred meters or more provide superior and evenly distributed RF supply along the whole waveguide without requiring repeaters like the prior art systems. Although FIGS. 4 to 6 depict annularly corrugated waveguides, the waveguide according to the embodiments may instead also comprises helical corrugations (not shown). I.e., generally, a waveguide according to the embodiments may be uncorrugated or comprise annular or helical corrugations. These different types of corrugations may also be combined within several waveguides of the system 100 according to the embodiments.

Figure 7:
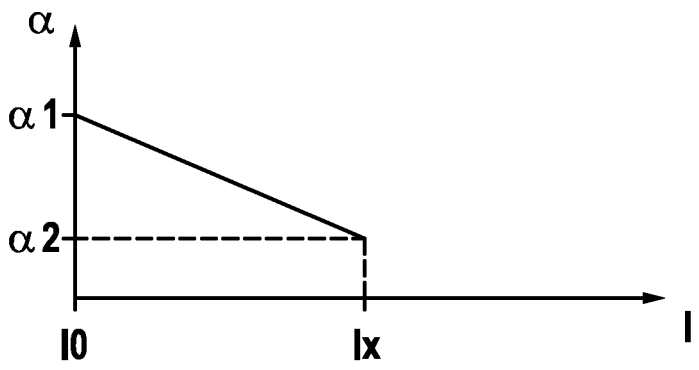
FIG. 7 depicts an angular position of the radiating openings of the waveguide versus a length of the waveguide according to an embodiment.

FIG. 7 exemplarily depicts an angular position α for the various openings 120_1, 120_2, . . . over the longitudinal coordinate l. Presently, the angular position linearly changes from a first value α1 to a second value α2 between the positions l0, lx along the elliptical waveguide. Further embodiments may also provide for a gradual, i.e. stepwise, or exponential or logarithmic change of the angular position α over length l, or combinations thereof, which may e.g. be applied to different length sections of the waveguide.

Apart from compensating longitudinal attenuation, the variation of the angular position α over length l according to the embodiments may advantageously be employed for defining different length sections of the waveguide 110*d* which provide for different radiated RF field strengths. For instance, when employing the system 100, 100*a* to provide RF coverage within a tunnel that has subsequent sections with different diameter and/or different attenuation characteristics, for a section with a larger tunnel diameter or attenuation characteristic, a first range of the angular position α of the openings may be contemplated which offers a higher degree of radiated energy, whereas for another tunnel section with a smaller tunnel diameter or attenuation characteristic, a further range of the angular position α of the respective openings may be contemplated which offers a smaller degree of radiated energy adapted to the smaller tunnel diameter. Of course, the arbitrary variation of the angular position α to account for the surrounding areas' volume may be combined with the—basically monotonous—variation of the angular position α that compensates for longitudinal attenuation, which depends on the length coordinate l, i.e. the distance of a specific waveguide section from the feeding end 130*a*.

In analogy to varying an angular position α of the openings along the length coordinate l of the waveguide 110, according to a further embodiment it is also possible to vary at least one physical property (size, shape, orientation of a normal vector of the opening's surface) of the openings 120_1, 120_2, . . . along the length coordinate l of the waveguide 110. These measures inter alia also enable to compensate a longitudinal attenuation along the length coordinate l to some extent. For instance, a size of the openings 120_1, 120_2, . . . may increase along the length coordinate l to compensate for the longitudinal attenuation. Combinations of the aforementioned measures are also possible.

According to a further embodiment, instead of providing a single waveguide with changing openings or changing angular positions of the openings along its length coordinate l, it is also possible to provide different waveguide sections or complete waveguides which have openings of same, i.e. constant properties, such as e.g. angular position, over the whole waveguide section or complete waveguide. With this configuration, a change of the properties along a length coordinate l may be effected when connecting in series the various waveguide sections or waveguides.

According to a further advantageous embodiment, different openings within the waveguide may also be arranged in several groups, wherein each group comprises a predetermined number of openings with the same parameters (angular position, size, and the like) along the length coordinate. In this case, different groups of openings may be arrange one after the other along the length coordinate. For instance, as seen from a first end, a waveguide 110 (FIG. 1) may comprise a first number of openings of a first type, and after that, along the length coordinate l, said waveguide may comprise a second number of openings of a second type, and so on. It is also possible to provide several openings in a first length section of the wave guide, and to provide no openings in a subsequent length section of the waveguide.

Figure 8:
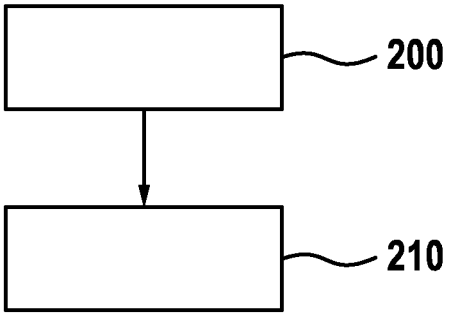
FIG. 8 depicts a simplified flow chart of a method according to an embodiment, and FIG. 9*a* to 9*f* schematically depict top views of waveguides with different configurations of radiating openings according to the embodiments.

FIG. 8 depicts a simplified block diagram of a method according to an embodiment. In a first step 200, an elliptical waveguide is provided. In a further step 210, a plurality of openings 120_1, 120_2, 120_3 (FIG. 1) are provided in the elliptical waveguide thus enabling electromagnetic waves being radiated from the interior to the exterior of the elliptical waveguide. I.e., after step 210, a radiating elliptical waveguide 110, 110*d* of the type as depicted by FIG. 1 or FIG. 6 is obtained.

According to a further embodiment, corrugations may be provided to the elliptical waveguide, either after the step 200 of providing the elliptical waveguide of FIG. 8 or in the course of providing, i.e. manufacturing the elliptical waveguide.

For example, an elliptical corrugated waveguide of the E60 type manufactured by Radio Frequency Systems could be used within step 200 as a basis for manufacturing the distributed antenna system according to the embodiments.

According to a further preferred embodiment, the waveguide 110 may be covered by a cable jacket (not shown) which also covers the radiating openings without significantly changing radiation characteristics.

According to a further embodiment, at least some of said openings 120_1, 120_2, . . . are created after a step of installing said waveguide 110*d* (FIG. 6) in the field, wherein said step of installing said waveguide 110*d* in the field preferably comprises bending at least one section of said waveguide 110*d*. Thus, a very precise creation of radiating sections having said openings 120_1, 120_2, . . . is possible, because the position of the openings 120_1, 120_2, . . . may be defined depending on the specific mounting condition of the elliptical waveguide 110*d* in the field, e.g. in a tunnel or the like. In its simplest form, at least some of the openings 120_1, 120_2, . . . according to this embodiment are made manually by a technician who assesses the mounting condition of the elliptical waveguide 110*d* in the field and who defines the positions of openings in the elliptical waveguide 110*d* depending thereon, e.g. assisted by measurement and/or simulation equipment for measuring and/or calculating a resulting electromagnetic field distribution with respect to the position of the waveguide 110*d* and its openings.

The benefits of the system according to the embodiments are a low longitudinal loss that allows using radiating waveguides for long distances at high frequencies. About 4 times longer passive systems can be achieved compared to conventional radiating coaxial cable.

Further, variable positioning of openings 120_1, 120_2, . . . (e.g., slots) on the circumference of the waveguide 100*d* (cf. the angular position α) enable gradual adjustment of coupling loss.

The elliptical waveguides 110*a*, 110*b*, 110*c*, 110*d* according to the embodiments are flexible and can advantageously be produced in very long, virtually endless, length. Installation is significantly faster and efficient compared with rectangular waveguides. Optionally, during manufacturing of the waveguides, only a first number of openings may be defined in the waveguide, e.g. according to a standard RF signal radiation behavior required in many cases. Further openings may even be defined in a waveguide installed in the field, i.e. manually by a service technician with a drilling machine or the like, to optimally account for individual mounting conditions.

The embodiments offer a particularly easy and quick installation due to the arbitrary lengths of waveguide material 110*d* that can be supplied in one piece (i.e., no connecting work as welding or the like required in the field), a homogeneous radiated RF signal coverage comparing to existing systems with discrete antennas or conventional radiating coaxial cables, easy implementation of the openings in the waveguide (e.g., by milling of an existing corrugated waveguide), low longitudinal loss of the radiating waveguide at high frequencies up to the 40 GHz range and higher, an opportunity of using standard accessories (connectors, clamps etc.) in case different waveguides have to be connected in the field, because the radiating waveguides according to the embodiments may be derived from standard-type waveguides or they may at least basically comprise the same geometrical form, especially at their end sections 130*a*, 130*b* (FIG. 6).

According to a further embodiment, at least one waveguide 110 of the system 100 (FIG. 1) is not required to have an exactly elliptical cross-section in a strict mathematical sense.

FIG. 9*a* to 9*f* schematically depict top views of waveguides 110*e*, . . . , 110*j* with different configurations of radiating openings according to the embodiments. For the sake of clarity, the various radiating openings are not individually assigned reference numerals, they are rather symbolized by elliptical and/or circular and/or rectangular shapes in FIG. 9*a* to 9*f*. Also, a cable jacket, which may cover the waveguide(s) 110*e*, . . . , 110*j* for electrical isolation and protection, is not depicted.

Figure 9A:
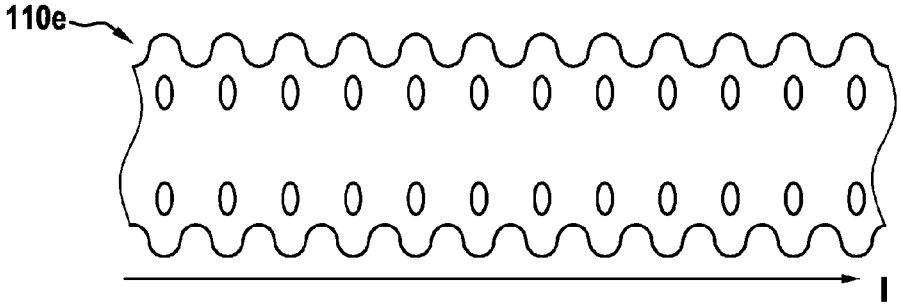
Figure 9B:
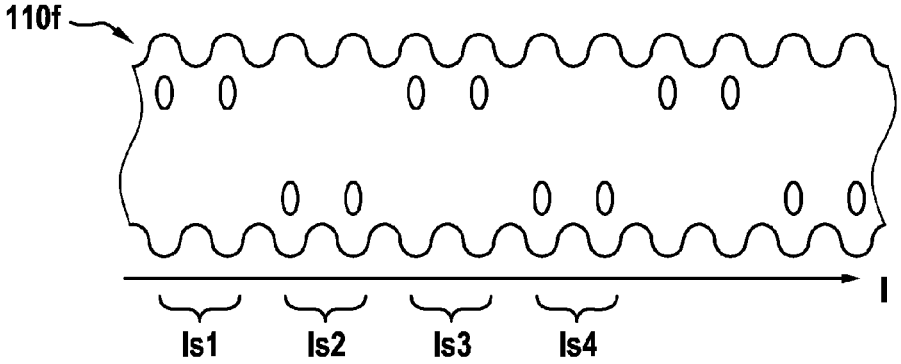

FIG. 9*a* depicts a radiating waveguide 110*e* which comprises along its length coordinate l two rows of radiating openings with identical geometry and equal inter-opening spacing along the length coordinate l. Each row can be interpreted to be arranged at a specific angular position $\alpha$ as explained above. According to further embodiments, a single row or more than two rows are also possible. Further, subsequent openings along the length coordinate l of a same row may also have varying angular position, whereby e.g. a helical configuration of openings (not shown) may be attained on the surface of the waveguide 110*e*. FIG. 9*b* depicts a radiating waveguide 110*f* which comprises along its length coordinate l two rows of radiating openings with identical geometry and equal inter-opening spacing per row along the length coordinate l. In contrast to the embodiment according to FIG. 9*a*, each row alternately comprises two openings and therebetween a length section comprising no openings. E.g., a first row of the FIG. 9*b* embodiment comprises two openings within the first length section ls1, whereas in a subsequent second length section ls2, the same first row does not comprise openings. This pattern repeats for the further length sections ls3, ls4. The second row of the FIG. 9*b* embodiment comprises a basically identical pattern of openings distributed along the length coordinate l, which is, however, shifted by a displacement corresponding to about the length of a length section ls1 with respect to the first row.

Figure 9C:
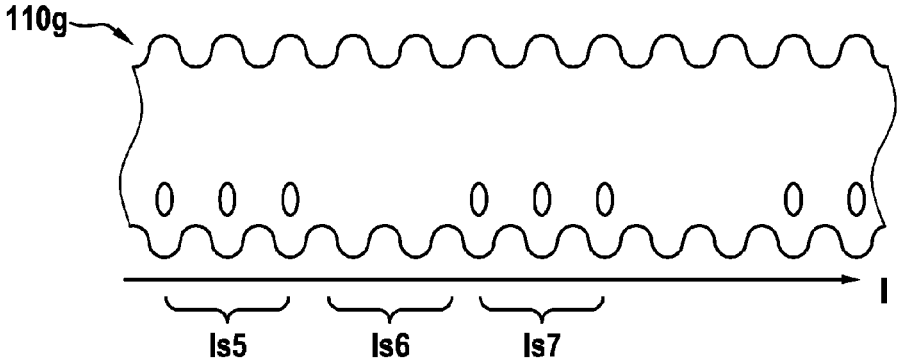

FIG. 9*c* depicts a waveguide 110*g* according to a further embodiment, wherein only a single row of radiating openings is provided. Along a length section ls5, three subsequent openings are depicted. The next length section ls6 is without openings and as such does not radiate. The further length section ls7 again comprises three openings.

Figure 9D:
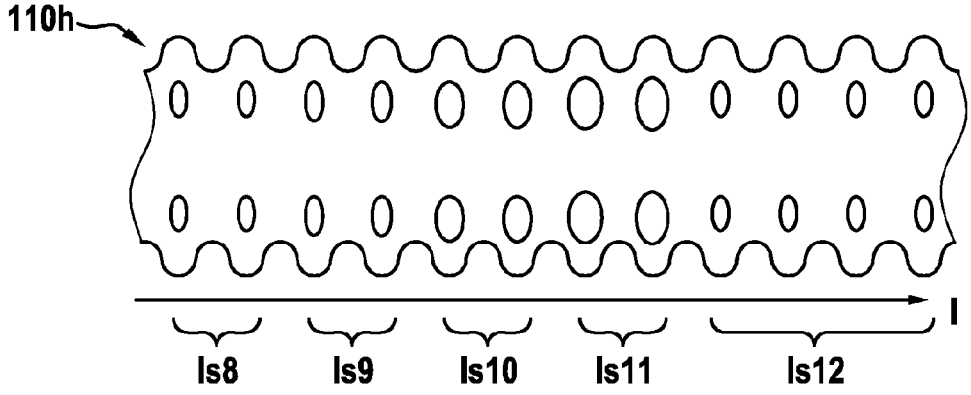

FIG. 9*d* depicts a radiating waveguide 110*h* which comprises along its length coordinate l two rows of radiating openings with about equal inter-opening spacing per row along the length coordinate l, but varying geometry, particularly size, along the length coordinate l. The openings comprised within length section ls8 are basically identical and comprise a comparatively small first opening size. The openings comprised within the next length section ls9 are again basically identical to each other and comprise a second opening size, which is larger than the first opening size. The length sections ls10, ls11 comprise even larger openings each. A further length section ls12 of the waveguide 110*h* comprises openings which have a size comparable to the openings of the length section ls8.

Figure 9E:
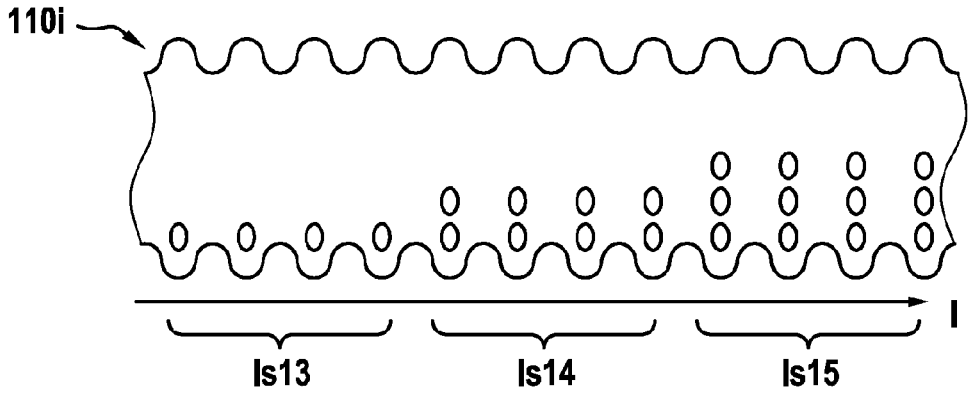

FIG. 9*e* depicts a radiating waveguide 110*i* which comprises along its length coordinate l an increasing number of rows of radiating openings with about equal inter-opening spacing per row along the length coordinate l. In a first length section ls13 of the waveguide 110*i*, only one row of openings is provided, whereas in a subsequent second length section ls15 of the waveguide 110*i*, two rows of openings are provided. In a further length section ls15 of the waveguide 110*i*, three rows of openings are provided.

Figure 9F:
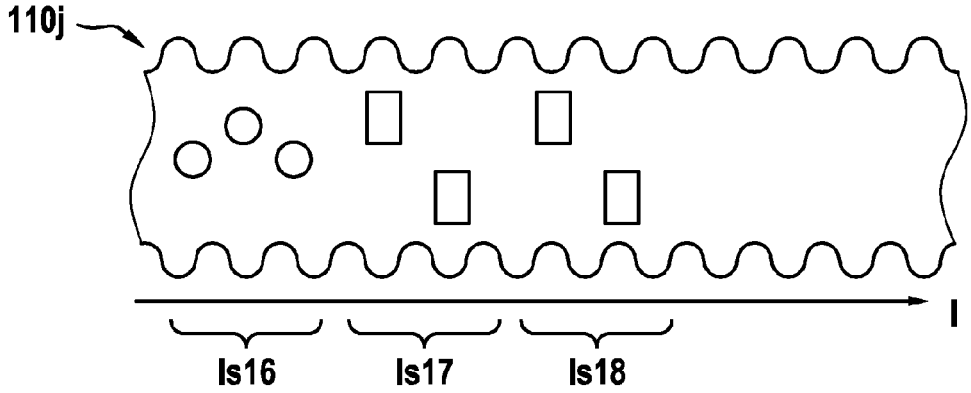

FIG. 9*f* depicts a radiating waveguide 110*j* which comprises along its length coordinate l various radiating openings that comprise different geometry. In a length section ls16, the openings provide a basically circular shape, whereas in the further length sections ls17, ls18, the openings comprise a rectangular shape. Other polygonal shapes are also possible for defining the radiating openings.

The aforementioned configurations of openings may also be combined with each other, either within a single waveguide or within different waveguides of the system 100.

The description and drawings merely illustrate the principles of the invention. It will thus be appreciated that those skilled in the art will be able to devise various arrangements that, although not explicitly described or shown herein, embody the principles of the invention and are included within its spirit and scope. Furthermore, all examples recited herein are principally intended expressly to be only for pedagogical purposes to aid the reader in understanding the principles of the invention and the concepts contributed by the inventor(s) to furthering the art, and are to be construed as being without limitation to such specifically recited examples and conditions. Moreover, all statements herein reciting principles, aspects, and embodiments of the invention, as well as specific examples thereof, are intended to encompass equivalents thereof.

The invention claimed is:

1. A distributed antenna system facilitating at least one of transmitting radio frequency (RF) signals and receiving RF signals, wherein said antenna system comprises at least one corrugated elliptical waveguide having an elliptical cross-section, wherein a length of a major axis of the elliptical cross-section is different from a length of a minor axis of the elliptical cross-section, wherein said waveguide comprises a plurality of openings distributed along a longitudinal axis of the elliptical waveguide, wherein different openings are provided at different length coordinates and arranged at different angular positions with respect to the major axis of the elliptical cross-section, wherein the plurality of openings include at least one of different size openings and different shape openings.

2. The distributed antenna system according to claim 1, wherein said openings are comprised within corrugated sections of said elliptical waveguide.

3. The distributed antenna system according to claim 1, wherein at least one of said openings comprises a substantially elliptical cross-section.

4. The distributed antenna system according to claim 1, wherein the angular position increases with a distance from a feeding end of the elliptical waveguide.

5. The distributed antenna system according to claim 1, wherein different ones of said plurality of openings comprise a different geometry with respect to a surface of the waveguide.

6. The distributed antenna system according to claim 1, wherein said at least one elliptical waveguide is configured to transmit electromagnetic waves with a frequency of at least 4 GHz.

7. The distributed antenna system according to claim 1, wherein said at least one elliptical waveguide comprises a longitudinal attenuation of about 4 dB per 100 meters for electromagnetic waves with a frequency of about 6 GHz.

8. The distributed antenna system according to claim 1, wherein the openings are comprised within non-corrugated sections of the elliptical waveguide.

9. The distributed antenna system according to claim 1, wherein different ones of the plurality of openings comprise a different geometry with respect to a longitudinal axis of the waveguide.

10. The distributed antenna system according to claim 1, wherein different ones of the plurality of openings comprise a different orientation with respect to a surface of the waveguide.

11. The distributed antenna system according to claim 1, wherein different ones of the plurality of openings comprise a different orientation with respect to a longitudinal axis of the waveguide.

12. The distributed antenna system according to claim 1, wherein the different angular positions include angular positions based on increasing the angular position up to 90 degrees in relation to a distance from a feeding end of the elliptical waveguide.

13. A method of manufacturing a distributed antenna system, wherein a corrugated elliptical waveguide having an elliptical cross-section is provided, wherein a length of a major axis of the elliptical cross-section is different from a length of a minor axis of the elliptical cross-section, wherein a plurality of openings are created within said elliptical waveguide, wherein the openings are distributed along a longitudinal axis of the elliptical waveguide, wherein different openings are provided at different length coordinates of the waveguide and arranged at different angular positions with respect to the major axis of the elliptical cross-section, wherein the plurality of openings include at least one of different size openings and different shape openings.

14. The method according to claim 13, wherein said openings are created by milling.

15. The method according to claim 13, wherein at least some of said openings are created after installing said waveguide in the field, wherein the corrugated elliptical waveguide facilitates bending at least one section of the waveguide during the installing of said waveguide in the field.

16. The method according to claim 13, wherein the openings are created by drilling.

17. The method according to claim 13, wherein the openings are created by laser cutting.

18. The method according to claim 13, wherein the angular position increases with a distance from a feeding end of the elliptical waveguide.

19. The method according to claim 13, wherein different ones of the plurality of openings comprise a different orientation with respect to a longitudinal axis of the waveguide.

20. The method according to claim 13, wherein the different angular positions include angular positions based on increasing the angular position up to 90 degrees in relation to a distance from a feeding end of the elliptical waveguide.

* * * * *